United States Patent [19]

Herwynen

[11] 4,119,175

[45] Oct. 10, 1978

[54] STEP LADDER

[76] Inventor: John Alfred Herwynen, King City Post Office, King City, Ontario, Canada

[21] Appl. No.: 541,840

[22] Filed: Jan. 17, 1975

[51] Int. Cl.[2] ..... E06C 1/24

[52] U.S. Cl. ..... 182/125

[58] Field of Search ..... 182/124, 125, 126, 176

[56] References Cited

U.S. PATENT DOCUMENTS

| | | | |
|---|---|---|---|
| 579,328 | 3/1897 | McConnell | 182/161 |
| 2,652,967 | 9/1953 | Hansen | 182/176 |
| 3,127,953 | 4/1964 | Shore | 182/125 |

FOREIGN PATENT DOCUMENTS

| | | | |
|---|---|---|---|
| 1,093,081 | 11/1954 | France | 182/161 |
| 508,095 | 1/1955 | Italy | 182/161 |
| 620,310 | 3/1949 | United Kingdom | 182/106 |

*Primary Examiner*—Reinaldo P. Machado

*Attorney, Agent, or Firm*—W. T. Howell

[57] ABSTRACT

A folding step ladder has a pair of front legs with a pair of back legs pivoted thereon, below which are upper and lower steps pivotably secured to the front pair of legs. A pair of spaced apart links are pivotably secured to the upper step at points rearwardly of its pivotal connections to the front legs and the other end of each link is pivotably connected to the rear legs at points below the upper step. The link members each have an abutment at this point which forms a stop for the ladder on unfolding. This is arranged through the action of a pair of arms, the upper ends of which are pivotably connected to the upper step rearwardly of the pivotal link connection thereto; the lower ends of the arms are pivotably secured to the rearward portion of the lower step. Each arm extends downwardly between an individual link and its adjacent rear leg but forwardly of the abutment to engage thereon when the ladder is unfolded.

1 Claim, 5 Drawing Figures

STEP LADDER

FIELD OF THE INVENTION

This invention relates to self-supporting folding metal ladders used more specifically in kitchen, household and apartment applications where the quality of minimum thickness of the folded ladder is of particular value for storing in confined places.

PRIOR ART

Present self-supporting folding ladders of the parallelogram design employ all rail members that support the ladder rungs in compression. Furthemore, rails of the parallelograms operate on the same plane so that the pairs of rails and steps butt together when closed resulting in a relatively bulky folded package.

The use of specific linkage to control the limit to which the ladder opens is another observation.

All such units at present known to the inventor employ such arrangements.

SUMMARY OF THE INVENTION

It is accordingly an object of this invention to use tension members and put these members in a plane slightly inside that of the compression members to allow the tension members to nest inside of the main compression rails when in the folded position. This allows the ladder to be folded such that the overall thickness is that of the one side rail plus that of the bracing leg with all other parts confined therein, resulting in a narrow parcel for confined storage space.

It is another object of the present invention to use the top steps as part of the two linkages that limit and control the extension of the legs. In addition, when the ladder is fully opened, the top step sits on the arms of the extension linkages to support the tension rails which carry the inside part of the steps. Furthermore, the linkages maintain the steps in a horizontal position. This multi-purpose use of members affords fewer parts per equivalent unit.

The main side rails carrying the ladder steps are formed as a unit that imposes stability to the structure.

This upper or cross bar portion of the unit affords a hand hold for ease of ascent and descent with the additional safety feature of leg support when maneuvering upright from the top step.

A further feature inherent in the design is the ease of opening the ladder by holding the main rail member at the top with bracing legs outward and pushing away with a foot at the top of the bottom step.

The step ladder has a front pair of spaced apart legs with a rear pair of spaced apart legs pivotal on the front pair. Upper and lower spaced apart steps are located below the pivot points of the rear pair of legs on the front pair of legs; these steps are pivotably secured to the front pair of legs. A pair of spaced apart link members are provided, the corresponding one end of which are pivotably secured to the upper step at points rearwardly of its pivotal connections to the front legs. The other ends of the link members are pivotably secured to the rear legs at points below the upper step. The link members are shaped so that each has an abutment adjacent its connection to the rear legs. The ladder also has a pair of arms, the upper ends being pivotably secured to the upper step rearwardly of the pivotal connection thereto of an individual link. Each arm then extends downwardly between an individual link and its adjacent rear leg but forwardly of the abutment on this link. The lower end of each arm is pivotably connected to the lower step rearwardly of the latter's connections to the forward pair of legs. When the ladder is unfolded the abutments provide a stop for the upper step.

DESCRIPTION OF A PREFERRED EMBODIMENT

Figure 1:
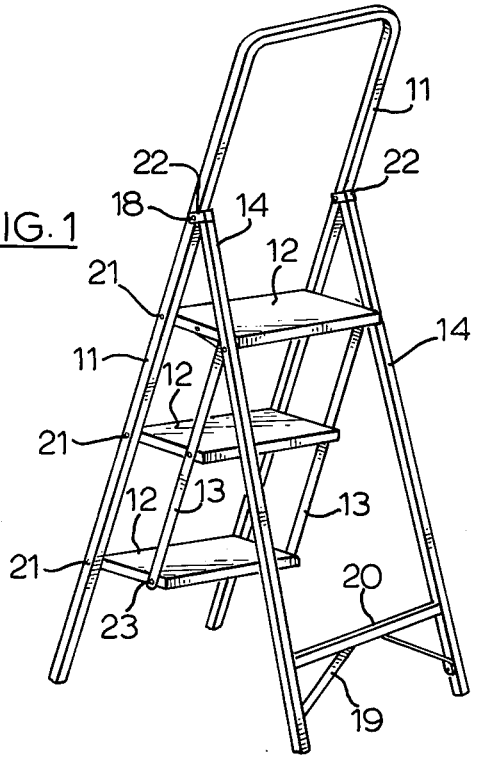
FIG. 1 is a general perspective view of the ladder in opened or operating position in accordance with the present invention.
Figure 4:
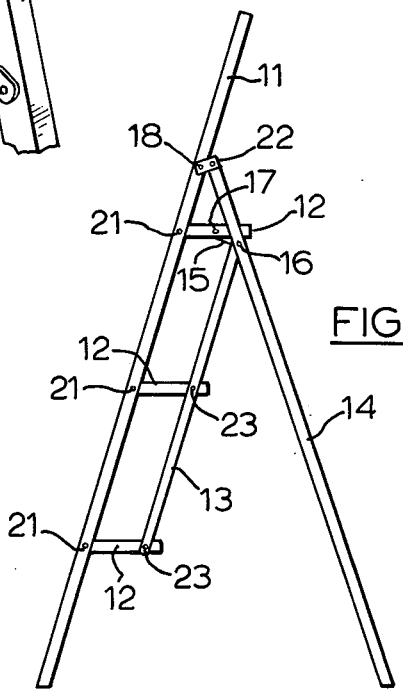
FIG. 4 is a side elevation of the ladder in the opened or operating position.

Referring to FIGS. 1 and 4, the parallelograms are apparent as formed by rail members 11 and 13 and the steps 12. The fasteners 21 and 23 permit pivoting.

Figure 5:
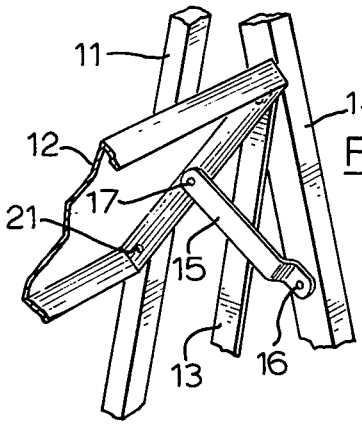
FIG. 5 is a perspective fragmentary view with the legs partly opened, showing one side of the top step forming part of the linkage which limits the spread of the legs and supports the tension members.

It can be understood readily from FIG. 5 how the top step 12 and member 15 form the linkage for opening and closing and how the top steps will sit upon the arm 15 when the ladder is fully opened.

It is further apparent in FIGS. 1 and 4 that when the steps are loaded and the top step is settled on 15 at pivot 16, the side rails 11 are in compression while the side rails 13 supporting the inside of the steps are in tension.

Figure 2:
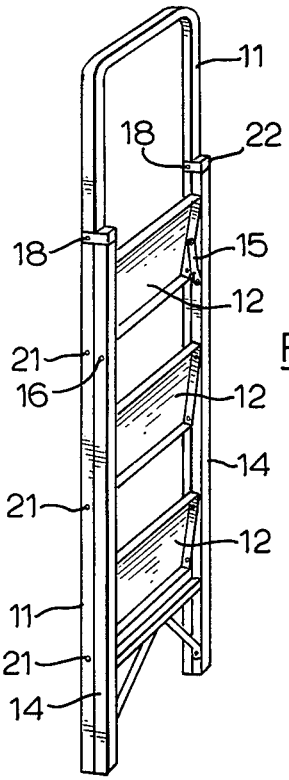
FIG. 2 is a general perspective view of the ladder in closed or storage position.
Figure 3:
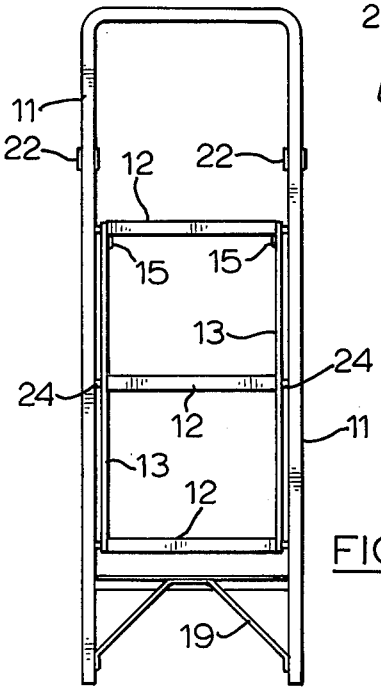
FIG. 3 is a front view of the ladder in the opened or operating position.

In FIG. 3 washer spacers 24 are slightly thicker than the thickness of members 13 and are placed on the main pivot fasteners 21 between the side rails 11 and the steps 12. This space allows rails 13 to swing between the steps 12 and the rails 11 during closing and opening. Properly chosen member sizes permit the back bracing legs 14 to nestle tight against *r* rails 11 when folded for storage as illustrated in FIG. 2.

In observing FIGS. 2 and 4 the bracing leg hinge member 22 is first fastened to legs 24 so that the channels composing the hinges are extended above the top of member 14 sufficiently to locate the fastener 18 to the rails 11 to allow members 11 and 14 to swing tightly together when closed and not to interfere one with the other when fully opened.

FIGS. 1, 2 and 3 illustrate members 19 and 20 used to stabilize the ladder against lateral movement.

I claim:

1. A foldable step ladder comprising a pair of front legs integrally connected in their upper parts, said front legs being pivotally connected in their upper parts to a corresponding pair of interconnected rear legs, two single step members pivotally connected between said front legs and a pair of rear tension rails pivotally interconnecting the rear of the sides of said steps to form a collapsible parallelogram, an unitary guiding link pivotally attached to each side of the top step intermediate to the ends thereof and to the corresponding inner side of said rear legs at a point below the top step, said top step resting on said guide links in the opened position of the ladder to limit rotation of the steps to a horizontal position and urging said top step to collapse said parallelogram on rotation of the said rear legs to a folded position, said guide links at said connection point below the top step extending towards the other a sufficient distance to each provide an abutment spaced from the individual leg from which it is pivotal, said top step resting on said abutments in the opened position of said ladder with said rear legs braced together below said lower step.

* * * * *